US006668405B1

(12) United States Patent
Kohlman

(10) Patent No.: US 6,668,405 B1
(45) Date of Patent: Dec. 30, 2003

(54) VARIABLE PRESSURE RELIEF INFLATED CUSHION

(75) Inventor: Steve Kohlman, Clarks Grove, MN (US)

(73) Assignee: Aquila Corporation of Wisconsin, Clarks Grove, MN (US)

( * ) Notice: Subject to any disclaimer, the term of this patent is extended or adjusted under 35 U.S.C. 154(b) by 0 days.

(21) Appl. No.: 10/043,857

(22) Filed: Jan. 9, 2002

Related U.S. Application Data

(60) Provisional application No. 60/260,561, filed on Jan. 9, 2001.

(51) Int. Cl.[7] ..... A47C 20/02
(52) U.S. Cl. ..... 5/654; 5/653; 5/657
(58) Field of Search ..... 5/653, 654, 713, 5/726, 652.1, 652.2, 657

(56) References Cited

U.S. PATENT DOCUMENTS

| | | | | | |
|---|---|---|---|---|---|
| 2,998,817 | A | | 9/1961 | Armstrong | 128/33 |
| 3,148,391 | A | | 9/1964 | Whitney | 5/348 |
| 4,175,297 | A | | 11/1979 | Robbins et al. | 5/284 |
| 4,912,788 | A | * | 4/1990 | Lonardo | 5/432 |
| 5,052,068 | A | * | 10/1991 | Graebe | 5/455 |
| 5,103,518 | A | | 4/1992 | Gilroy et al. | 5/453 |
| 5,109,560 | A | | 5/1992 | Uetake | 5/453 |
| 5,163,196 | A | * | 11/1992 | Graebe et al. | 5/654 |
| 5,390,384 | A | * | 2/1995 | Dinsmoor, III et al. | 5/654 |
| 5,427,331 | A | | 6/1995 | Stroud | 244/122 |
| 5,487,197 | A | | 1/1996 | Iskra, Jr. et al. | 5/654 |
| 5,500,965 | A | | 3/1996 | Hannagan et al. | 5/654 |
| 5,613,257 | A | * | 3/1997 | Graebe | 5/654 |
| 5,701,622 | A | | 12/1997 | Biggie et al. | 5/713 |
| 5,839,140 | A | * | 11/1998 | Wilkerson | 5/654 |
| 5,845,352 | A | * | 12/1998 | Matsler et al. | 5/654 |
| 5,963,997 | A | | 10/1999 | Hagopian | 5/654 |
| 6,014,784 | A | | 1/2000 | Taylor et al. | 5/713 |
| 6,094,762 | A | | 8/2000 | Viard et al. | 5/713 |
| 6,216,299 | B1 | | 4/2001 | Kohlman | 5/654 |
| 6,392,166 | B1 | | 5/2002 | Fortune et al. | 177/144 |
| 2002/0128572 | A1 | | 9/2002 | Chang | 601/148 |

* cited by examiner

*Primary Examiner*—Teri Pham Luu
(74) *Attorney, Agent, or Firm*—Sherrill Law Offices, PLLC

(57) ABSTRACT

A cushion having a plurality of inflatable and deflatable cells useful for periodically shifting the points of contact between the cushion and a body supported by the cushion in order to reduce or eliminate the development of pressure sores. The cushion includes one or more of (i) at least two encircling cells shaped so as to define a central concavity in the upper surface of each of the encircling cells, (ii) at least one repositionable cell, (iii) at least two cells having contoured upper surfaces which define a longitudinally extending laterally concave channel, and (iv) two groupings of independently inflatable and deflatable cells arranged asymmetrically about a longitudinal axis.

30 Claims, 7 Drawing Sheets

VARIABLE PRESSURE RELIEF INFLATED CUSHION

This application claims the benefit of U.S. provisional patent application Serial No. 60/260,561 filed Jan. 9, 2001

BACKGROUND

Persons with limited mobility, such as the elderly or persons confined to a wheelchair are susceptible to the development of pressure sores. Pressure sores are formed when the tissue is compressed for extended periods of time causing a restriction in the flow of blood. The exchange of nutrients and waste in the compressed tissue cells is slowed, resulting in skin breakdown and the formation of pressure sores. The retention of heat and moisture are two additional factors that contribute to the formation of pressure sores. Areas most vulnerable to pressure sore formation are bony areas having little tissue between the bone and the skin, including such areas as the ischial tuberosities, coccyx and sacrum.

U.S. Pat. No. 6,216,299 discloses a wheelchair cushion system wherein the cushion includes an array of inflatable square pockets including first and second interconnected groupings of pockets interspersed throughout the array which are independently inflated and deflated on a predetermined schedule in order to vary the location of contact between the cushion and the body of a person seated on the cushion.

While providing a significant advance in efforts to reduce the development of pressure sores on persons confined to wheel chairs, pressure sores remain a persistent problem for those with limited mobility and a continuing need exists for further improvements in devices capable of reducing or eliminating the development of pressure sores caused by daily prolonged seating.

SUMMARY OF THE INVENTION

The invention is a cushion having a plurality of inflatable and deflatable cells useful for periodically shifting the points of contact between the cushion and a body supported by the cushion in order to reduce or eliminate the development of pressure sores.

A first embodiment of the cushion has at least two encircling cells shaped so as to define a central concavity in the upper surface of each of the encircling cells.

A second embodiment of the cushion has at least one cell repositionably attached to the first major surface of a base for allowing repositioning of the cell on the base. It is generally preferred that at least one of the encircling cells is repositionably attached to the first major surface of the base. Such repositionability of the cells allows positioning of the cells to correspond with the location of one of more of the ischial tuberosities, coccyx, and sacrum of each specific user and thereby provide appropriate pressure relief.

A third embodiment of the cushion has at least two contoured cells with each contoured cell independently defining a longitudinally extending laterally concave channel on the upper surface of the contoured cell.

A fourth embodiment of the cushion has a majority of the cells symmetrically configured and arranged on opposite sides of a central longitudinal axis wherein (i) a first set of the symmetrically configured and arranged cells are jointly inflatable and deflatable, (ii) a second set of the symmetrically configured and arranged cells are jointly inflatable and deflatable, and (iii) the first set of jointly inflatable and deflatable cells are asymmetrically configured and arranged relative to the second set of jointly inflatable and deflatable cells on opposite sides of the central longitudinal axis.

DETAILED DESCRIPTION OF THE INVENTION INCLUDING A BEST MODE

Figure 1:
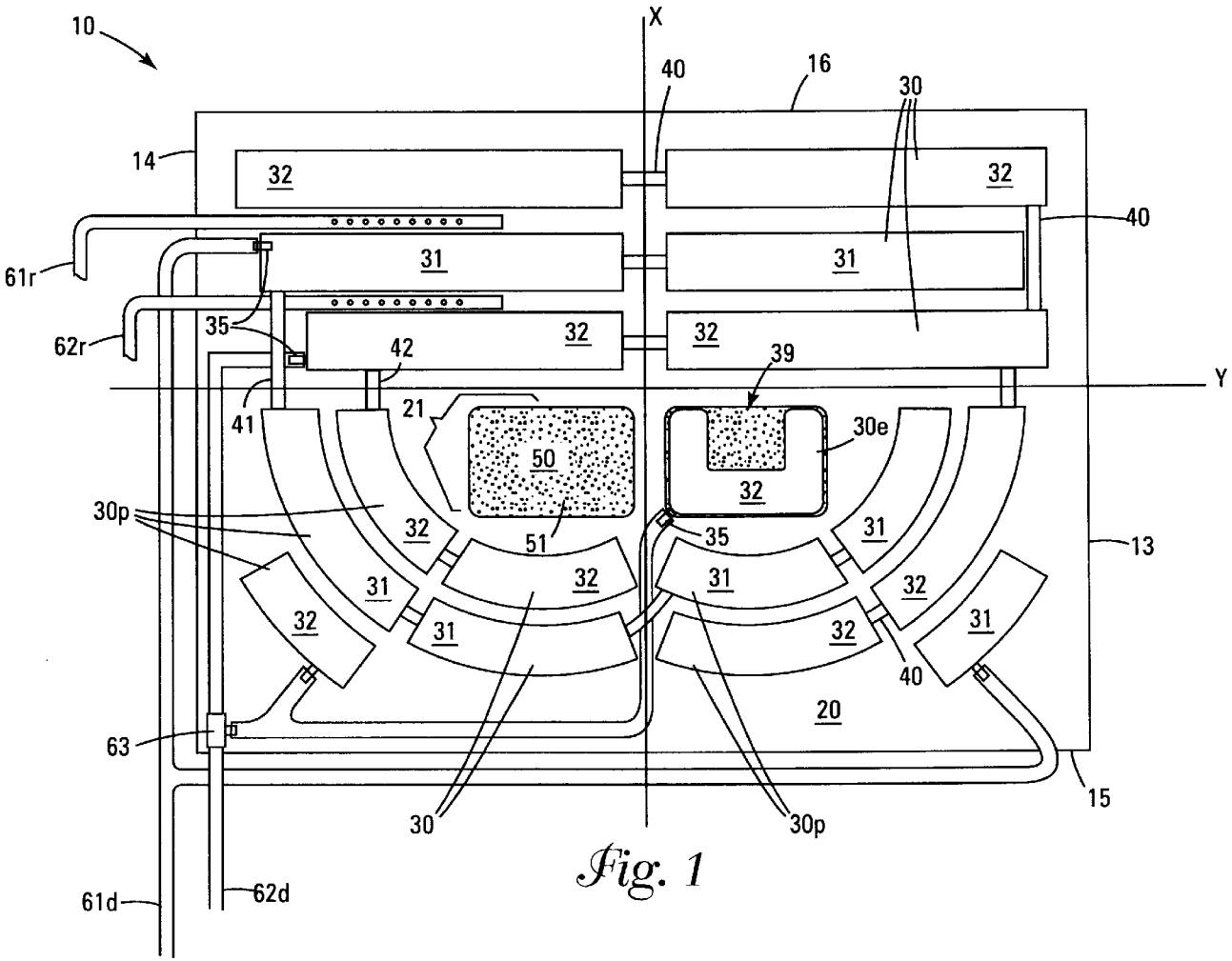
FIG. 1 is a top view of one embodiment of a seating cushion with the cover and an encircling cell removed to facilitate viewing of internal components.

Nomenclature x Central Longitudinal Axis
y Central Latitudinal Axis
z Central Transverse Axis
10 Seating Cushion
11 Top of Seating Cushion
12 Bottom of Seating Cushion
13 First Side of Seating Cushion
14 Second Side of Seating Cushion
15 Front End of Seating Cushion
16 Back End of Seating Cushion
20 Base
21 Platform Area
30 Cells
**30*e*** Encircling Cells
**30*p*** Peripheral Cells
31 First Group of Cells
32 Second Group of Cells
33 Upper Surface of Cells
34 Lower Surface of Cells
35 Access Orifice
38 Concave Channel
39 Void or Cavity
40 Connecting Tunnel
41 Connecting Tunnels Connecting the First Group of Cells
42 Connecting Tunnels Connecting the Second Group of Cells

50 Hook and Loop Tape
51 First Half of Hook and Loop Tape
52 Second Half of Hook and Loop Tape
61*d* First Delivery Tube
61*r* First Return Tube
62*d* Second Delivery Tube
62*r* Second Return Tube
63 T-Fitting
70 Cover
71 Top of Cover
72 Bottom of Cover
73 First Side of Cover
74 Second Side of Cover
75 Front of Cover
76 Back of Cover
77 Opening
78 Zipper
80 Control Box
81 Housing
82 Power Switch
83 Battery
84 Recharging Socket
85 Recharging Unit
86 Pump Timer
87 First Cycle Timer
88 Second Cycle Timer
89 Pressure Switch
90 Buzzer
91 Air Pump
92 Check Valve
93 Main Delivery Tube
94 First Valve
95 Discharge Port
96 Second Valve
97 Second Discharge Port
99 Manual Pump
100 Evaporation and Cooling System
110 Control Box
112 Power Switch
113 Battery
114 Recharging Socket
115 Recharging Unit
116 AirPump
120 Air Delivery Tube
121 Holes
200 Back support Cushion
220 Base
230 Cells
231 First Group of Cells
232 Second Group of Cells
233 Upper Surface of Cells
235 Access Orifice
240 Connecting Tunnel
241 Connecting Tunnels Connecting the First Group of Cells
242 Connecting Tunnels Connecting the Second Group of Cells
261*d* First Delivery Tube
261*r* First Return Tube
262*d* Second Delivery Tube
262*r* Second Return Tube
270 Air Supply Tube
280 Cover
281 Top of Cover
282 Bottom of Cover
283 First Side of Cover
284 Second Side of Cover
285 Front of Cover
286 Back of Cover
287 Retaining Straps
288 Zipper

Definitions

As utilized herein, including the claims, the phrase "encircling cell" means a cell configured and arranged with an upper surface which defines a completely (100%) or partially (at least 60%) surrounded void or cavity. Encircling cells permit positioning of a protuberance or selected area, such as an ischial tuberosity, within the void or cavity so that the cell while reducing or eliminating pressure can provide support exerted upon the protuberance or selected area positioned within the void or cavity.

As utilized herein, including the claims, the phrase "hollow cell" means a cell having a central transversely open cavity.

As utilized herein, including the claims, the term "majority" means greater than 50%.

As utilized herein, including the claims, the phrase "uninterrupted fluid communication" means an interconnection allowing for the free, unrestrained and uncontrolled conveyance of fluid from one location to another.

As utilized herein, including the claims, the phrase "substantially different size or shape" means (i) a volume differential of at least 20%, or (ii) a maximum common volume of less than 80%.

As utilized herein, including the claims, the phrase "maximum common volume" is calculated by dividing the greatest volume capable of being occupied by both objects when the objects are permitted to occupy the same three dimensional space, divided by the combined volume of the two objects.

Construction

Seating Cushion

The seating cushion 10 includes a base 20, cells 30 and a control box 80. The seating cushion 10 can be used in connection with any type of seating including standard residential and office chairs, airplane seats, vehicle seating, etc., but is particularly suited for use with wheelchairs (not shown).

The base 20 is preferably a planar sheet of material having sufficient structural integrity, such as rubber, neoprene, urethane, vinyl, or plastisol.

The cells 30 must be constructed from a material having sufficient structural integrity to support an individual in a seated or prone position upon the inflated cells 30.

In addition, the cells 30 must be capable of withstanding repeated inflation and deflation cycles. The cells 30 are preferably constructed of a resilient material such as, but not limited to rubber, neoprene, urethane, vinyl, or plastisol.

The cells 30 are connected to a base 20 by any conventional means, including specifically, but not exclusively heat sealing or adhesive bonding.

Figure 7:
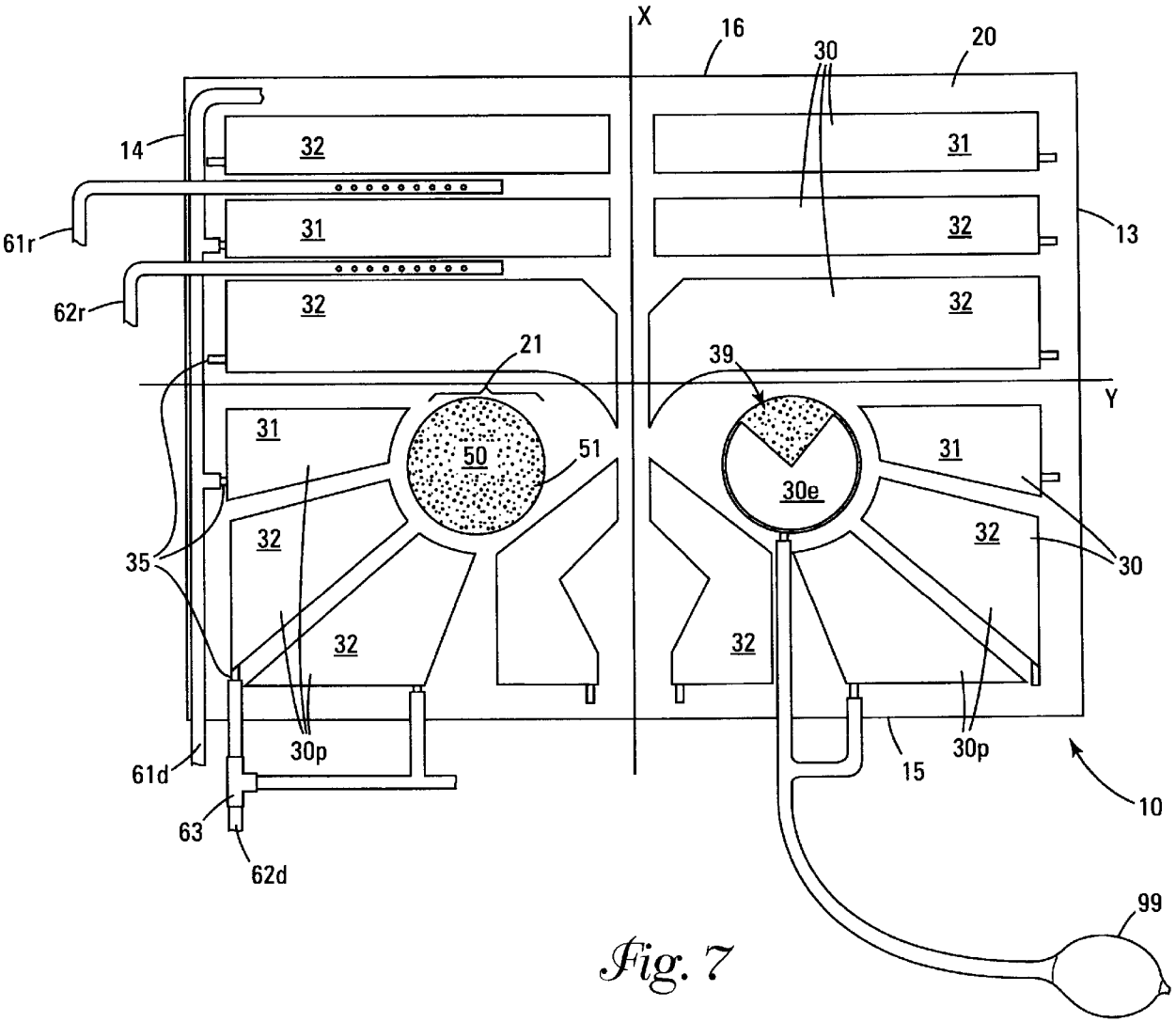
FIG. 7 is a top view of another embodiment of a seating cushion with the cover and an encircling cell removed to facilitate viewing of internal components.

As shown in FIGS. 1 and 7, the cushion 10 preferably includes a pair of laterally spaced encircling cells 30*e* having the same or different shapes. The encircling cells 30*e* include a void or cavity 39 in the upper surface 33, such as a continuous central passage as shown in FIG. 1 or a sector-shaped cut-out as shown in FIG. 7. The void or cavity 39 in the encircling cells 30*e* allows the encircling cells 30*e* to support the perimeter of an area or protuberance (not shown) on the posterior (not shown) of a user (not shown), such as an ischial tuberosity (not shown), without directly touching the area or protuberance. Suitable shapes for an encircling cell 30*e* include any of a wide variety of hollows, notched, indented, or otherwise voided, regular or irregular shapes. Such shapes include specifically, but not exclusively, a transversely extending U, a hollow cube, a hollow rectangle, a hollow right cylinder, a hollow frustum of right cone, a torus, a hollow spherical sector, a hollow conical ring, a cube with a concave upper surface, a rectangle with a concave upper surface, a right cylinder with a concave upper surface, a frustum of right cone with a concave upper surface, a side notched cube, a side notched rectangle, a side notched right cylinder, a side notched frustum of right cone, etc.

In one embodiment, the encircling cells 30*e* are repositionably attached to the base 20 within a platform area 21 so as to allow repositioning of the encircling cells 30*e* to corresponding with the specific location of a user's ischial tuberosities (not shown). A particularly suitable means for respositionably attaching the encircling cells 30*e* to the base 20 is with hook and loop tape 50 wherein a first half 51 of the hook and loop tape 50 is secured to the base 20 so as to cover substantially the entire area constituting the platform area 21, and a second half 52 of the hook and loop tape 50 secured to the lower surface 34 of the encircling cells 30*e*. A respositionable pressure sensitive adhesive may also be employed. Other cells 30 may also be repositionably attached to the base 20.

As shown in FIGS. 1 and 7, the cushion 10 also preferably includes peripheral cells 30*p* extending concentrically or radially from each encircling cell 30*e*. The peripheral cells 30*p* may have the same or different shapes. As shown in FIG. 1, the cushion 10 can include several rows of peripheral cells 30*p* extending along several different concentric lines so as to define inner, outer and intermediate levels of peripheral cells 30*p*.

The configuration and arrangement of the cells 30, including the encircling cells 30*e* and peripheral cells 30*p*, facilitates pressure relief in the areas of greatest concern for the development of pressure sores, including the ischial tuberosities, coccyx, and sacrum.

The cells 30, especially the encircling cells 30*e*, are preferably symmetrically configured and arranged on opposite sides of a central longitudinal axis x.

In one aspect, shown in FIG. 1, only selected cells 30 are equipped with an access orifice 35 and the cells 30 are interconnected by connecting tunnels 40 into individually inflatable and deflatable cell groups (e.g., a first group of cells 31 and a second group of cells 32 with the first group of cells 31 fluidly connected to one another by a plurality of first connecting tunnels 41, and the second group of cells 32 fluidly connected to one another by a plurality of second connecting tunnels 42).

In another aspect, shown in FIG. 7, each cell 30 is equipped with an access orifice 35 and the cells 30 are interconnected by tubing into individually inflatable and deflatable cell groups (e.g., a first group of cells 31 and a second group of cells 32 with the first group of cells 31 fluidly connected to one another by a branched first delivery tube 61*d*, and the second group of cells 32 fluidly connected to one another by a branched second delivery tube 62*d*).

The first 31 and second 32 cell groups are symmetrically or asymmetrically distributed throughout the base 20 so that each cell group can individually support a user (not shown) seated upon the seating cushion 10. The two encircling cells 30*e* may be placed together in the same cell group or in separate cell groups as desired. In a preferred embodiment, the encircling cells 30*e* are split between the two cell groups with one of the encircling cells 30*e* in the first group 31 and the other encircling cell 30*e* in the second group 32.

The aspect shown in FIG. 7 facilitates last minute customization of cell groupings, including grouping of the encircling cells 30*e*, to accommodate the specific needs and desires of a particular user (not shown). The aspect shown in FIG. 7 also permits selected cells 30 to be fluidly disconnected from both the first 31 and second 32 cell groups and connected to a manual pump 99, such as an inflation bulb, for independent inflation and deflation by the user.

Figure 3:
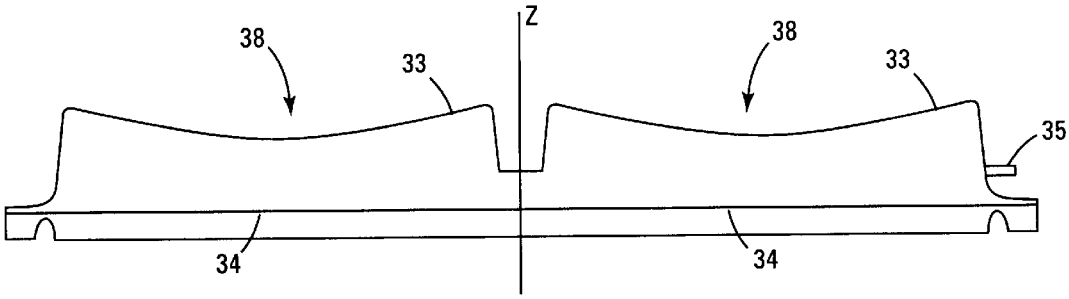
FIG. 3 is an end view of a pair of fluidly interconnected cells on a seating cushion.
Figure 4:
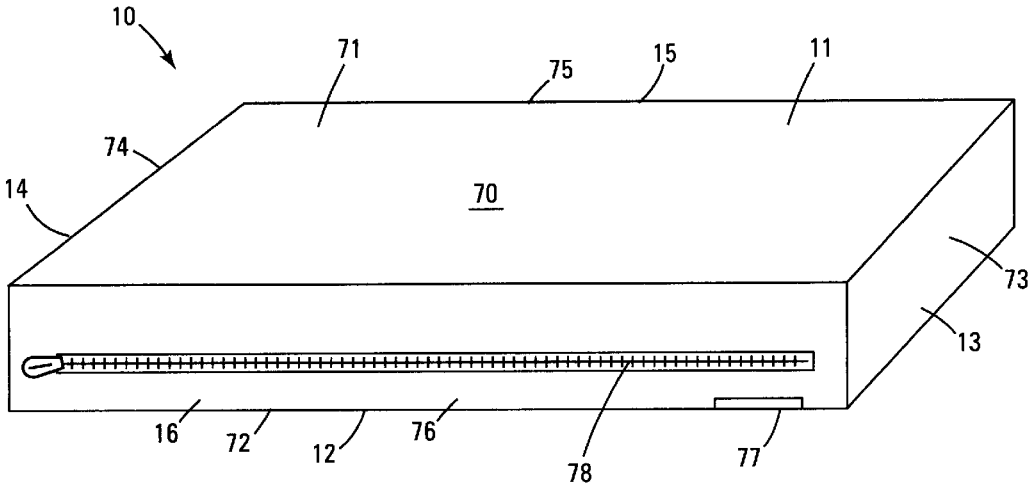
FIG. 4 is a perspective view of one embodiment of a covered seating cushion.
Figure 5:
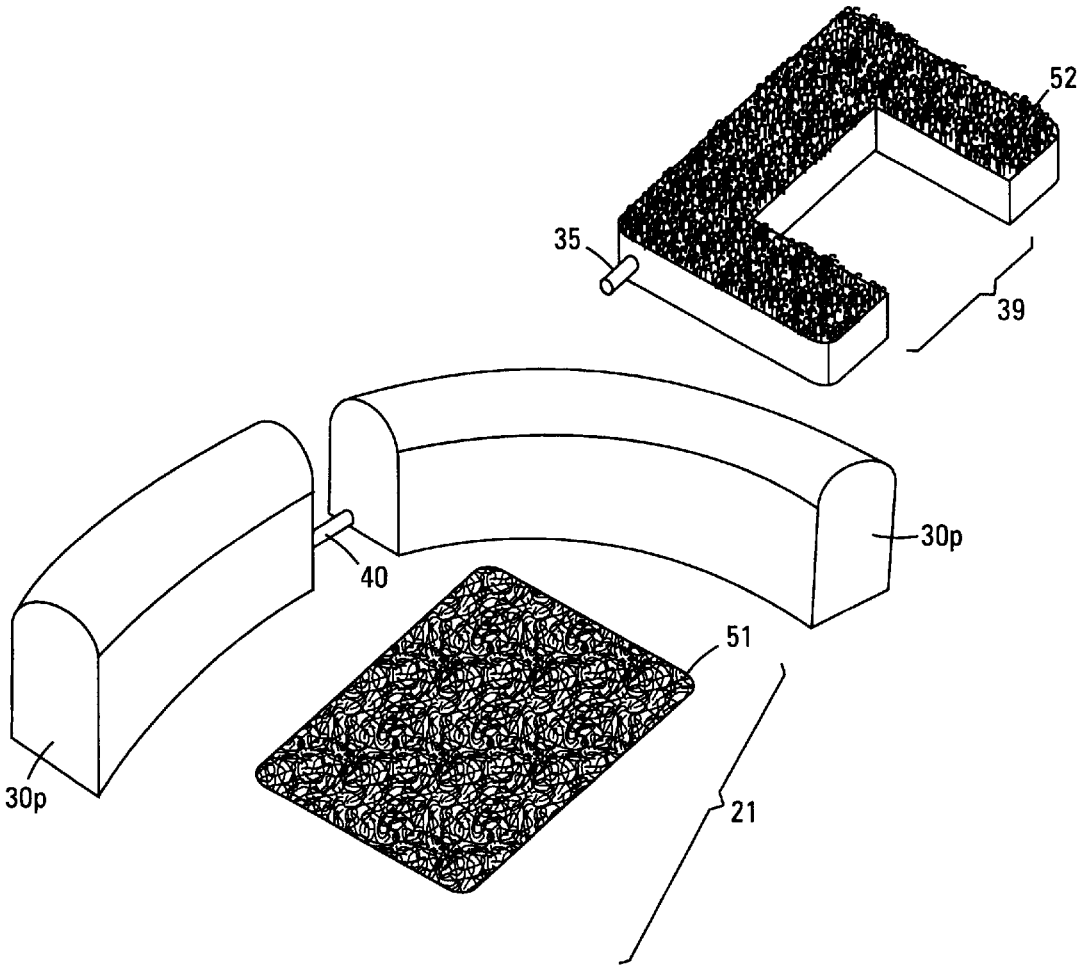
FIG. 5 is an exploded perspective view of a platform area; a pair of peripheral cells and an encircling cell.
Figure 6:
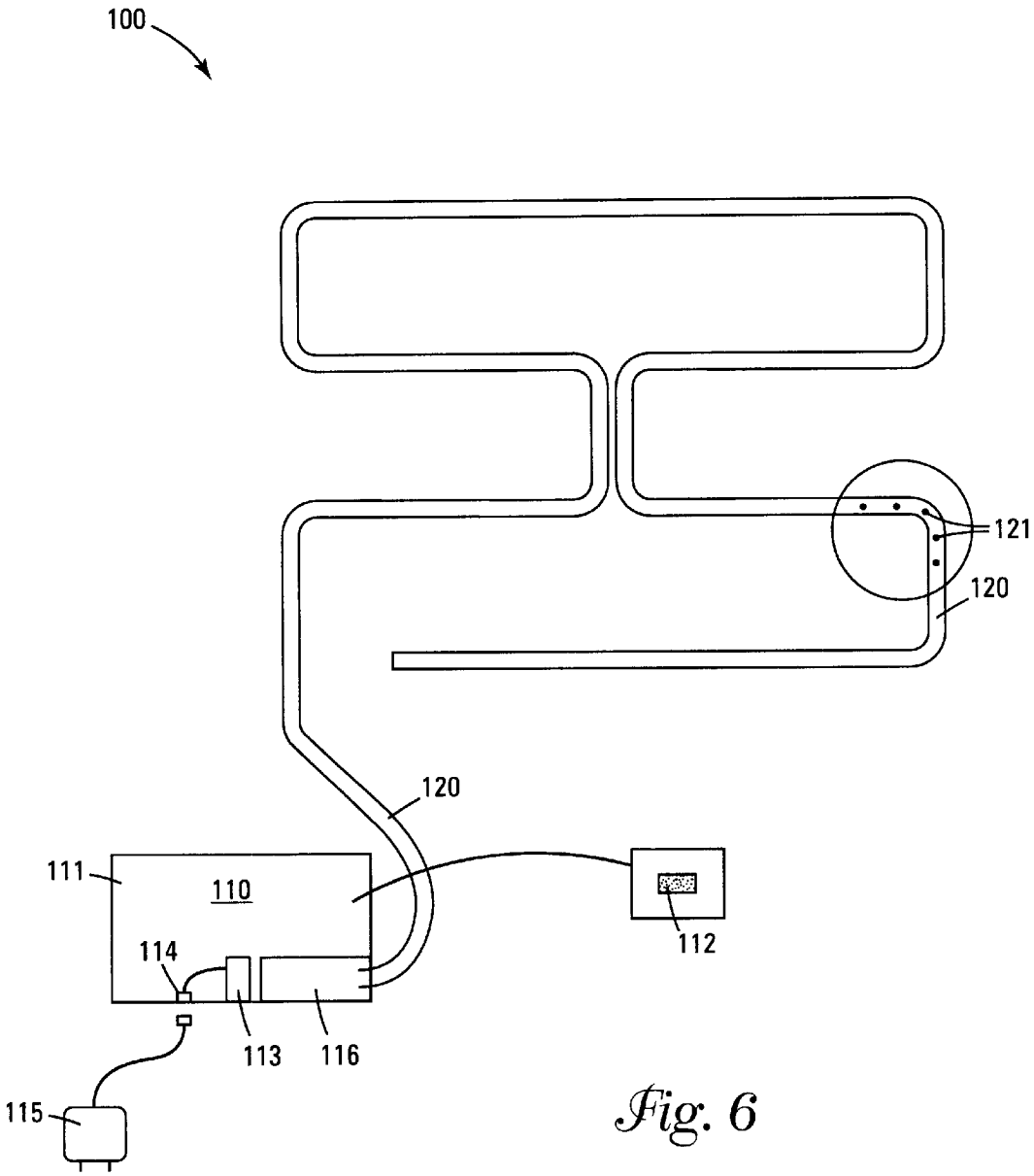
FIG. 6 is a top view of one embodiment of an evaporative cooling system.

As shown in FIG. 3, at least some and desirably all of the peripheral cells 30*p* preferably have an upper surface 33 contoured with a longitudinally extending laterally concave channel 38 designed to match the natural curves of the human body and provide a more comfortable and stable seating area.

The base 20 and cells 30 are preferably surrounded with a removable cover 70. At least the top 71 of the cover 70 should be permeable so that air flowing from the return tubes 61*r* and 62*r* and/or air delivery tube 120 into the cover 70 can flow through the top 71 of the cover 70 and thereby ventilate the areas of contact between a user (not shown) and the cushion 10. The cover 70 can be constructed from a perforated material but is preferably constructed from a permeable fabric such as cotton or a cotton/polyester blend. If desired the cover 70 can be constructed from a gas permeable moisture impermeable material such as Gortex®.

The cover 70 is preferably provided with a zipper 78 so that the cover 70 may be removed and laundered or replaced. An opening 77, preferably along a seam (not shown) permits passage of the delivery tubes 61*d* and 62*d*, return tubes 61*r* and 62*r*, and cooling air delivery tube 120 through the cover 70.

Figure 2:
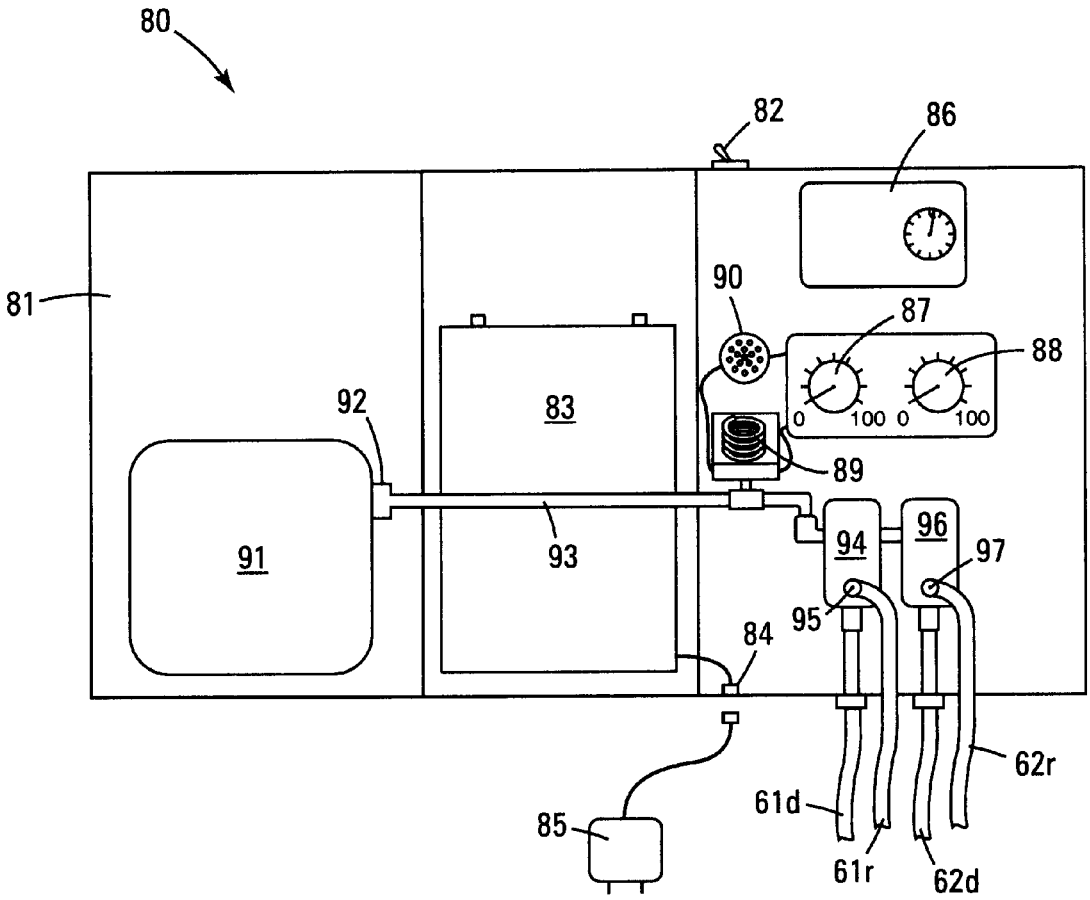
FIG. 2 is a schematic view of one embodiment of a control unit for timed inflation and deflation of the cells.

A suitable control box 80 is disclosed in U.S. Letters Pat. No. 6,216,299, the disclosure of which is hereby incorporated by reference. Briefly, the control box 80 described in United States Letters Pat. No. 6,216,299 and shown in FIG. 2 includes (i) an air pump 91, (ii) a battery 83, (iii) a power switch 82 electrically connected to the battery 83, (iv) a pump timer 86 electrically connected to the power switch 82 and the air pump 91, (v) a first cycle timer 87 electrically connected to the power switch 82 and a first valve 94 wherein the first valve 94 is fluidly connected between the air pump 91 and the first group of cells 31, and (vi) a second cycle timer 88 electrically connected to the power switch 82 and a second valve 96 wherein the second valve 96 is fluidly connected between the air pump 91 and the second group of cells 32.

A check valve 92 is preferably positioned along the main delivery tube 93 between the air pump 91 and the valves 94 and 96 for preventing airflow from reversing and entering the air pump 91 when operation of the air pump 91 is terminated.

A differential pressure switch 89 is preferably placed in fluid communication with the main delivery tube 93 downstream from the check valve 92 for detecting fluid pressure within the main delivery tube 93 and thereby detecting fluid pressure within the currently inflated group of cells 31 or 32.

The pressure switch 89 is electrically connected to a suitable device for generating a perceptible signal, such as a buzzer 90 for activating the buzzer 90 and emitting an audible warning when low pressure is detected by the pressure switch 89. Alternatively, separate pressure switches 89 may be placed in fluid communication with each of the first 31 and second 32 cell groups.

The control box 80 allows the user (not shown) to control the amount of fluid pressure within the cells 30 by adjusting the pump timer 86, which controls the duration of operation of the air pump 91. The control box 80 also allows the user (not shown) to control the amount of time that each of the first 31 and second 32 cell groups are inflated by adjusting the first cycle timer 87 and second cycle timer 88 respectively.

A recharging socket 84 can be provided for electrically connecting the battery 83 to a recharging unit 85 so as to allow recharging of the battery 83.

A housing 81 supports and encloses all of the electrical components of the control box 80. Support straps (not shown) are preferably attached to the housing 81 for selectively engaging and supporting the housing 81 to a wheelchair (not shown) or other suitable structure.

A first delivery tube 61d fluidly connects the first valve 94 to the first group of cells 31 for delivering pressurized fluid to the first group of cells 31 when air pump 91 is operating and the first valve 94 is open. A second delivery tube 62*d* fluidly connects the second valve 96 to the second group of cells 32 for delivering pressurized fluid to the second group of cells 32 when air pump 91 is operating and the second valve 96 is open.

The first cycle timer 87 is adjustable by the user (not shown) and determines the period of time that the first valve 94 is open. The first valve 94 includes a first discharge port 95 that is closed when the first valve 94 is open. The first discharge port 95 opens when the first valve 94 is closed.

The second cycle timer 88 is similarly adjustable by the user (not shown) and determines the period of time that the second valve 96 is open. The second valve 96 includes a second discharge port 97 that is closed when the second valve 96 is open. The second discharge port 97 opens when the second valve 96 is closed.

A first return tube 61*r* is fluidly connected to the first discharge port 95 of the first valve 94. A second return tube 62*r* is fluidly connected to the second discharge port 97 of the second valve 96. A distal end (unnumbered) of each return tube 61*r* and 62*r* is positioned between the cells 30. The return tubes 61*r* and 62*r* each include a plurality of holes (unnumbered) through the return tube 61*r* and 62*r* over that length of the return tube 61*r* and 62*r* positioned within the cover 70 for the purpose of dispersing fluid received from the respective discharge port 95 and 97 when the respective valve 94 and 96 is closed. The return tubes 61*r* and 62*r* may extend between the cells 30 in any desired configuration to achieve the desired ventilation between the cushion 10 and a user (not shown) seated upon the cushion 10.

Alternating the load bearing responsibility between the first group of cells 31 and the second group of cells 32 alternates the pressure contact points between the user (not shown) and the cushion 10 and thereby helps prevent the formation of pressure sores.

Evaporative Cooling System

The cushion 10 may optionally be equipped with an active evaporative cooling system 100 which includes a control box 110 and an evaporative cooling air delivery tube 120 for preventing the build-up of heat and moisture between the cushion 10 and user (not shown) seated on the cushion 10. The control box 110 includes (i) an air pump 116 fluidly connected to the evaporative cooling air delivery tube 120, (ii) a battery 113, and (iii) a power switch 112 electrically connected to the air pump 116 and the battery 113.

A recharging socket 114 can be provided for electrically connecting the battery 113 to a recharging unit 115 so as to allow recharging of the battery 113.

The evaporative cooling air delivery tube 120 is fluidly connected to the air pump 116 at one end with the opposite end positioned within the cover 70 between the cells 30. The evaporative cooling air delivery tube 120 has a plurality of holes 121 over that length of the tube 120 positioned within the cover 70 for the purpose of dispersing air pumped by the air pump 116 into the cover 70 and out through the air permeable top 71 of the cover 70.

Back Support Cushion

A back support cushion 200 may optionally be used in conjunction with the seat cushion 10. The back support cushion 200 includes a base 220, cells 230 and a control box (not shown).

The base 220 is preferably a planar sheet of material having sufficient structural integrity, such as rubber, neoprene, urethane, vinyl, or plastisol.

The cells 230 must be constructed from a material having sufficient structural integrity to support the back of a seated individual upon the inflated cells 230. In addition, the cells 230 must be capable of withstanding repeated inflation and deflation cycles. The cells 230 are preferably constructed of a resilient material such as, but not limited to rubber, neoprene, urethane, vinyl, or plastisol.

The cells 230 are connected to a base 220 by any conventional means, including specifically, but not exclusively heat sealing or adhesive bonding.

Figure 8:
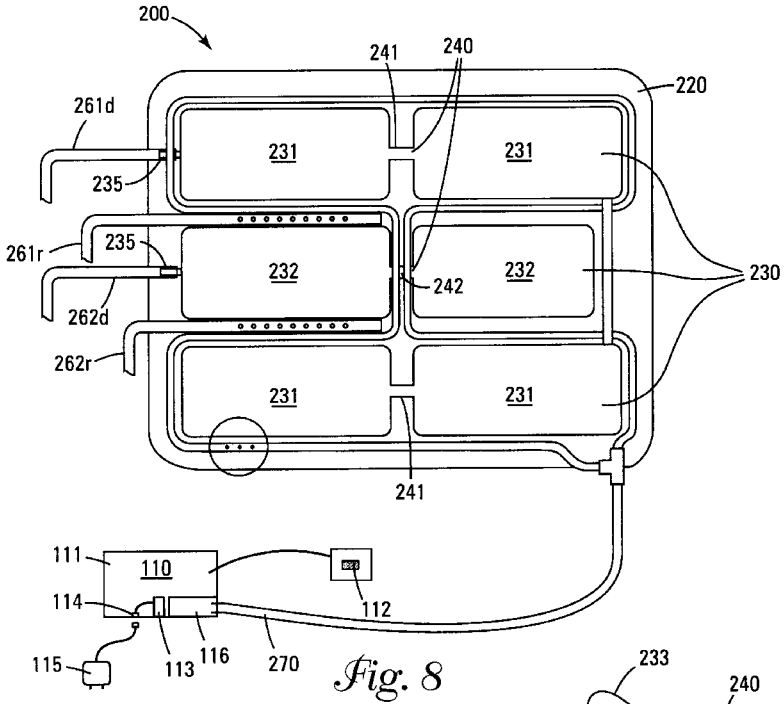
FIG. 8 is a top view of one embodiment of a back support cushion with the cover removed to facilitate viewing of internal components.
Figure 9:
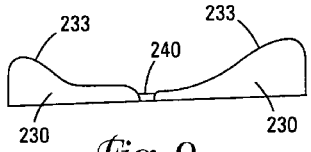
FIG. 9 is an end view of a pair of fluidly interconnected cells on a back support cushion.
Figure 10:
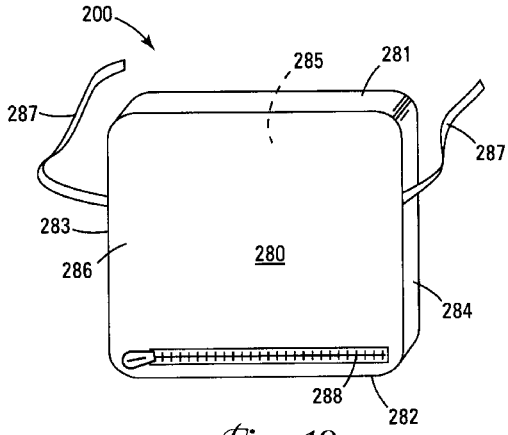
FIG. 10 is a perspective view of one embodiment of a covered back support cushion.

As shown in FIG. 8, the back cushion 200 preferably includes at least two longitudinal columns and three lateral rows of rectangular cells 230. The cells 230 may be repositionably attached to the base 220 so as to allow customized repositioning of the cells 230. The configuration and arrangement of the cells 230 provides maximum comfort and support to the back, including the lumbar region of the back.

In one aspect, all cells 230 are fluidly interconnected by connection tunnels 240 such that all cells 230 are inflated and deflated together.

In another aspect, only selected cells 230 have an access orifice 235 and the cells 230 are interconnected by connection tunnels 240 into a first group of cells 231 and a second group of cells 232 with the first group of cells 231 fluidly connected to one another by first connecting tunnel(s) 241, and the second group of cells 232 fluidly connected to one another by second connecting tunnel(s) 242.

In yet another aspect, each cell 230 has an access orifice 235 and the cells 230 are interconnected into a first group of cells 231 and a second group of cells 232 with the first group of cells 231 fluidly connected to one another by a branched first delivery tube 261*d*, and the second group of cells 232 fluidly connected to one another by a branched second delivery tube 262*d*.

When the cells 230 are grouped into first 231 and second 232 cell groups, the first 231 and second 232 cell groups are distributed throughout the base 220 so that each group can individually comfortably support the back (not shown) of a user (not shown) resting upon the cushion 200.

The aspect in which each cell 230 has an access orifice 235 facilitates customization of cell grouping in order to suit the particular needs and desired of a specific user.

At least some, and desirably all, of the cells 230 preferably have an upper surface 233 contoured to match the natural shape and curves of the human body and thereby provide a more comfortable and stable back support.

The base 220 and cells 230 are preferably surrounded with a removable cover 280. At least the front 285 of the cover 280 should be permeable so that air flowing from the return tubes 261*r* and 262*r* and/or evaporative cooling air supply tube 270 into the cover 280 can flow through the cover 280 and thereby ventilate the areas of contact between the cushion 200 and a user (not shown) resting upon the back cushion 200. The cover 280 can be constructed from a perforated material but is preferably constructed from a permeable fabric such as cotton or a cotton/polyester blend. The cover 280 can be constructed from a gas permeable and moisture impermeable material such as Gortex®.

The cover 280 is preferably provided with a zipper 288 so that the cover 280 may be removed and laundered or replaced. An open area (not shown), preferably along a seam (not shown) permits passage of the delivery tubes 261*d* and 262*d*, return tubes 261*r* and 262*r*, and cooling air supply tube 270 through the cover 280.

The cover 280 preferably includes straps 287 for securing the back support cushion 200 to the back (not shown) of a chair (not shown)

Those control boxes 80 described as suitable for use in connection with the seating cushion 10 are also suitable for use with the back support cushion 200.

The fluid connection system described as suitable for use in connection with the seating cushion 10 for the delivery and return of pressurizing fluid to the cells 30 is also suitable for use with the back support cushion 200.

The evaporative cooling system 100 described as suitable for use in connection with the seating cushion 10 for the delivery of evaporative cooling air to the cushion 10 is also suitable for use with the back support cushion 200.

Use

A user (not shown) adjusts the pump timer 86 to the desired amount of time depending upon the weight and personal preference of the user (not shown). Generally, pumping time should increase as the user's weight increases. The user (not shown) then adjusts the first cycle timer 87 and the second cycle timer 88 to the desired time intervals between inflation and deflation cycles. The user then positions the base 20 of the seat cushion 10 upon the seat (not shown) of the chair (not shown) and connects the control box 80 to the chair (not shown).

To initiate cycling, the user (not shown) closes the power switch 82 and thereby provides electrical power to the pump timer 86 and the first cycle timer 87. The air pump 91 will operate for the period of time (T1) specified by the pump timer 86 while the first cycle timer 87 opens the first valve 94 for a period of time (T2) specified by the first cycle timer 87 so as to allow air pumped by the air pump 91 to enter and inflate the first group of cells 31. When time period T1 is reached, operation of the air pump 91 is terminated. During the time the first valve 94 is open, the second valve 96 should be closed.

When time period T2 is reached, the first valve 94 is closed. Closing of the first valve 94 causes the first discharge port 95 to open and release the air pressure from within the first group of cells 31 through the now open first discharge port 95 and into the first return tube 61*r* where it is dissipated through holes (unnumbered) so as to dry and cool the user's body in contact with the cushion 10.

The air pump 91 then operates again for the period of time (T1) specified by the pump timer 86 while the second cycle timer 88 opens the second valve 96 for the period of time (T3) specified by the second cycle timer 88 so as to allow air pumped by the air pump 91 to enter and inflate the second group of cells 32. When time period T1 is reached, operation of the air pump 91 is terminated. During the time the second valve 96 is open, the first valve 94 should be closed.

When time period (T3) is reached, the second valve 96 is closed. Closing of the second valve 96 causes the second discharge port 97 to open and releases the air pressure from within the second group of cells 32 through the second discharge port 97 and into the second return tube 62*r* where it is dissipated through holes (unnumbered) so as to again dry and cool the user's body in contact with the cushion 10.

The process is repeated until the power switch 82 is opened.

When a manual pump 99 is connected to one or more of the cells 30, the user may inflate and deflate those cells 30 as desired.

The same process applies to use of the back cushion 200.

I claim:

1. A cushion comprising (a) laterally spaced sides, longitudinally spaced ends, transversely spaced major surfaces, and (b) a plurality of inflatable and deflatable cells with transversely spaced upper and lower surfaces wherein at least two of the cells are a first encircling cell and a second encircling cell (i) shaped so as to define a central concavity in the upper surface of each of the first and second encirclingcells, (ii) symetrically configured and arranged on opposite sides of a central longitudinal axis, and (iii) independently inflatable and deflatable.

2. The cushion of claim 1 wherein the central concavity in each encircling cell is a continuous central passage.

3. The cushion of claim 1 wherein the first and second encircling cells have the same shape.

4. The cushion of claim 1 wherein the first and second encircling cells are hollow cells.

5. The cushion of claim 1 wherein the fire and second encircling cells are U-shaped cells.

6. The cushion of claim 1 wherein a majority of the cells are symmetrically configured and arranged on opposite sides of the central longitudinal axis.

7. The cushion of claim 1 wherein (i) at least one laterally and longitudinally curved first peripheral cell is concentrically configured and arranged relative to the first encircling cell, and (ii) at least one laterally and longitudinally curved second peripheral cell is concentrically configured and arranged relative to the second encircling cell.

8. The cushion of claim 7 wherein (i) the first and second encircling cells are independently inflatable and deflatable, (ii) the first encircling cell and the second peripheral cell are jointly inflatable and deflatable, and (iii) the second encircling cell and the first peripheral cell are jointly inflatable and deflatable.

9. The cushion of claim 8 wherein (iv) the first encircling cell and the second peripheral cell are in uninterrupted fluid communication, and (v) the second encircling cell and the first peripheral cell are in uninterrupted fluid communication.

10. The cushion of claim 1 wherein the cells include at least (i) an inner, an intermediate and an outer concentrically spaced laterally and longitudinally curved first set of peripheral cells concentrically configured and arranged relative to the first encircling cell, and (ii) an inner, an intermediate and an outer concentrically spaced laterally and longitudinally curved second set of peripheral cells concentrically configured and arranged relative to the second encircling cell.

11. The cushion of claim 1 wherein (i) a plurality of the cells are peripheral cells, (ii) at least two of the peripheral cells radially extend from the first encircling cell, and (iii) at least two peripheral cells radially extend from the second encircling cell.

12. The cushion of claim 1 wherein the cells include at least (i) an inner and an outer concentrically spaced laterally and longitudinally curved first pair of peripheral cells concentrically configured and arranged relative to the first encircling cell, and (ii) an inner and an outer concentrically spaced laterally and longitudinally curved second pair of peripheral cells concentrically configured and arranged relative to the second encircling cell.

13. A cushion comprising (i) a base having laterally spaced sides, longitudinally spaced ends, and transversely spaced first and second major surfaces, and (ii) a plurality of inflatable and deflatable cells with at least one cell repositionably attached to the first major surface of the base for allowing repositioning of the cell on the base (A) independently of at least one other inflatable and deflatable cell and (B) in at least one of the longitudinal and lateral directions.

14. The cushion of claim 13 wherein at least two cells have a substantially different size or shape.

15. The cushion of claim 13 wherein at least two cells are repositionably attached to the first major surface of the base for allowing repositioning of the cells on the base in at least one of the longitudinal and lateral directions.

16. The cushion of claim 15 wherein at least two of the repositionable cells have a substantially different size or shape.

17. The cushion of claim 13 wherein (i) the cells have transversely spaced upper and lower surfaces, (ii) at least two of the cells are a first encirclingcell and a second encircling cell shaped so as to define a central concavity in the upper surface of each of the encircling cells, and (iii) at least one of the encircling cells is a repositionable cell.

18. The cushion of claim 17 wherein at least the encircling cells are symmetrically configured and arranged on opposite sides of a central longitudinal axis.

19. The cushion of claim 18 wherein a majority of the cells are symmetrically configured and arranged on opposite sides of the central longitudinal axis.

20. The cushion of claim 18 wherein (i) at least one laterally and longitudinally curved first peripheral cell is concentrically configured and arranged relative to the first encircling cell, and (ii) at least one laterally and longitudinally curved second peripheral cell is concentrically configured and arranged relative to the second encircling cell.

21. The cushion of claim 20 wherein (i) the first and second encircling cells are independently inflatable and deflatable, (ii) the first encircling cell and the second peripheral cell are jointly inflatable and deflatable, and (iii) the second encircling cell and the first peripheral cell are jointly inflatable and deflatable.

22. The cushion of claim 21 wherein (iv) the first encircling cell and the second peripheral cell are in uninterrupted fluid communication, and (v) the second encircling cell and the first peripheral cell are in uninterrupted fluid communication.

23. The cushion of claim 18 wherein the cells include at least (i) an inner and an outer concentrically spaced laterally and longitudinally curved first pair of peripheral cells concentrically configured and arranged relative to the first encircling cell, and (ii) an inner and an outer concentrically spaced laterally and longitudinally curved second pair of peripheral cells concentrically configured and arranged relative to the second encircling cell.

24. The cushion of claim 18 wherein the cells include at least (i) an inner, an intermediate and an outer concentrically spaced laterally and longitudinally curved first set of peripheral cells concentrically configured and arranged relative to the first encircling cell, and (ii) an inner, an intermediate and an outer concentrically spaced laterally and longitudinally curved second set of peripheral cells concentrically configured and ranged relative to the second encircling cell.

25. The cushion of claim 18 wherein the first and second encircling cells are independently inflatable and deflatable.

26. A cushion comprising (a) a base having laterally spaced sides, longitudinally spaced ends, and transversely spaced first and second major surfaces, and (b) a plurality of inflatable and deflatable cells attached to the first major surface of the base with transversely spaced upper and lower surfaces wherein at least two of the cells are contoured cells with each contoured cell independently having an upper surface defining a longitudinally extending laterally concave channel.

27. The cushion of claim 26 wherein the at least two contoured-cells are symmetrically configured and arranged on opposite sides of a central longitudinal axis.

28. The cushion of claim 27 wherein (i) the at least two contoured cells include a first a contoured cell positioned on a first side of the central longitudinal axis and a second contoured cell positioned on a second side of the central longitudinal axis, and (ii) the first and second contoured cells are independently inflatable and deflatable.

29. A cushion comprising (i) a base having laterally spaced sides, longitudinally spaced ends, and transversely spaced first and second major surfaces, and (ii) a plurality of inflatable and deflatable cells, (iii) wherein (a) at least a majority of the cells are symmetrically configured and arranged on opposite sides of a central longitudinal axis, (b) a first set of the symmetrically configured and arranged cells are jointly inflatable and deflatable, (c) a second set of the symmetrically configured and arranged cells are jointly inflatable and deflatable, and (d) the first set of jointly inflatable and deflatable cells are asymmetrically configured and arranged relative to the second set of jointly inflatable and deflatable cells on opposite sides of the central longitudinal axis.

30. The cushion of claim 29 wherein all of the cells are symmetrically configured and arranged on opposite sides of a central longitudinal axis.

* * * * *

UNITED STATES PATENT AND TRADEMARK OFFICE

CERTIFICATE OF CORRECTION

PATENT NO. : 6,668,405 B1
DATED : December 30, 2003
INVENTOR(S) : Kohlman

It is certified that error appears in the above-identified patent and that said Letters Patent is hereby corrected as shown below:

Column 5,
Line 2, “laterally spaced” should read -- laterally y spaced --

Column 10,
Line 27, “encirclingcells” should read -- encircling cells -- and “symetrically” should read -- symmetrically --

Column 11,
Line 31, “encirclingcells” should read -- encircling cells --

Column 12,
Line 30, “contoured-cells” should read -- contoured cells --

Signed and Sealed this

Twenty-second Day of March, 2005

JON W. DUDAS
*Director of the United States Patent and Trademark Office*